US005328261A

United States Patent [19]

Castano

[11] Patent Number: 5,328,261

[45] Date of Patent: Jul. 12, 1994

[54] METHOD AND APPARATUS FOR DISSOLVING POWDER IN A LIQUID

[75] Inventor: John M. Castano, 106 Kay St., Newport, R.I. 02840

[73] Assignee: The United States of America as represented by the Secretary of the Navy

[21] Appl. No.: 130,942

[22] Filed: Oct. 4, 1993

[51] Int. Cl.[5] ..... B01F 13/02; B01F 11/00

[52] U.S. Cl. ..... 366/102; 366/128; 366/172

[58] Field of Search ..... 366/10.1, 10.2, 106, 366/107, 154, 167, 168, 172, 3, 5, 11, 150, 108, 128, 114; 528/499, 502

[56] References Cited

U.S. PATENT DOCUMENTS

| | | | |
|---|---|---|---|
| 3,752,446 | 8/1973 | Watanabe . | |
| 3,840,213 | 10/1974 | Kormos | 366/168 |
| 3,995,839 | 12/1976 | Zingg | 366/167 |
| 4,077,612 | 3/1978 | Ricciardi | 366/102 |
| 4,529,794 | 7/1985 | Sortwell | 528/499 |
| 4,603,156 | 7/1986 | Sortwell | 528/499 |
| 4,685,810 | 8/1987 | Sakuichi . | |

*Primary Examiner*—Robert W. Jenkins
*Attorney, Agent, or Firm*—Michael J. McGowan; Prithvi C. Lall; Michael F. Oglo

[57] ABSTRACT

A system including an apparatus and method for dissolving powder into a liquid is disclosed. The apparatus includes a powder supply device which supplies powder, such as a water soluble resin polymer which is to be dissolved in water, to a powder and air mixing chamber. Pressurized air, at a low pressure, is mixed with the powder to provide an air and powder mixture. The pressurized air and powder mixture is supplied to the bottom of a powder and liquid mixing tank, below the surface of the liquid. A mechanical mixer gently agitates the liquid while the low pressure powder and air mixture is supplied to the mixing tank, to assure generally uniform distribution and dissolving of the powder in the liquid.

16 Claims, 1 Drawing Sheet

METHOD AND APPARATUS FOR DISSOLVING POWDER IN A LIQUID

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

This invention relates to an apparatus and method for mixing dry powders in a liquid and more particularly, to an apparatus and method by which a water soluble powder or polymer, may be directly and uniformly dissolved in water in high concentrations without excessive agitation.

(2) Description of the Prior Art

The reduced drag observed in liquid flows when small quantities of polymer are present in the fluid has created a need for mixing the polymer powder uniformly in the carrier fluid. Water soluble resin (WSR) polymers such as Polyox TM brand of polyethylene-oxide, (trademark of Union Carbide), have been used for many years in such a drag reducing role and have developed a good performance record. In the past, however, WSR polymer mixing was a two step process. First, the powder is dispersed in glycerol (in which Polyox will not dissolve), then the Polyoxglycerol slurry is introduced into the carrier fluid (usually water).

At the present time, however, glycerol which is utilized as the emulsion fluid, is considered a hazardous material, requiring an environmental impact statement for any technique which ejects or utilizes glycerol as a drag reducing agent. This is operationally as well as cost prohibitive, and has lead to a requirement for mixing the polymer directly into the carrier fluid which in many cases is fresh water.

In the direct mixing prior art, the mixing of the polymer has been accomplished by mixing the polymer powder with water by hand, carefully and slowly stirring the solution until the necessary concentration was reached. This is extremely difficult because for a uniformly distributed solution of concentrated polymer and water, the local molecular concentration during mixing cannot exceed 1% percent at anytime. When the local concentration exceeds 1%, the polymer coagulates into a very viscus gum which will not dissolve easily into the solution without employing high shear mixing techniques.

The drag reducing effectiveness of the polymer depends on the high molecular weight, or size, of the long chain polymer molecules. If the long chains are broken, as can occur through high shear mixing, the drag reducing performance of the solution is drastically diminished. Hence, there is a need for a low shear, WSR polymer water mixing device and method which can disburse the polymer more sufficiently to keep local molecular concentration below 1%.

Prior art devices and methods for directly mixing powders or suitable water soluble resin polymers into water include U.S. Pat. No. 4,077,612 which pre-wet the resin powder in a turbulent pre-wetting chamber, and then discharge the wetted resin into a mixing vat above the surface of the water, such that the wetted resin falls down into the water.

Another prior art device and method includes the type disclosed in U.S. Pat. No. 3,752,446 which completely dissolves the resin in turbulent mixing chambers by providing a stream of air carrying resin particles which is turbulently carried in a spray of water.

A further prior art device such as disclosed in U.S. Pat. No. 4,685,810, by Sakuichi, et al. uses a high pressure air feed to feed the powder resin into a water vat below the surface of the water using high pressure jets. The high pressure jets inject the powder resin into the water and agitate the water to mix the resin with the water. A single, high pressure jet is not sufficient, however, to assure local concentrations do not exceed 1%. In addition, at high polymer concentrations, Non-Newton effects reduce air bubble breakdown, allowing dry powder to escape through the upper surface. This requires additional low level agitation and an evenly distributed array of turbulent jets in the tank.

Due to the violently turbulent nature of the mixing of the above prior art devices, high sheer stresses are created that breakdown the long chains of polymers in the resin resulting in a solution with drastically diminished drag reducing capabilities.

SUMMARY OF THE INVENTION

It is an object of the present invention to provide an apparatus and method which uniformly mixes a powder, such as a water soluble resin polymer, with a liquid such as water, at high concentrations.

It is a further of the present invention to provide such a system and method which imposes low shear stresses on the mixture, thereby avoiding the breakdown of the polymer chains.

It is still a further object of the present invention to provide an apparatus and method which provides highly uniform mixing capabilities and avoids local high molecular concentrations of the dissolved powder in the water.

The system according to the present invention includes a powder aerator comprising a vibrating hopper which slowly feeds the powder into a powder and air mixing chamber, for mixing the powder with low pressure air. After the powder has been aerated and disbursed in the mixing chamber, the powder and air mixture is forced from the powder and air mixing chamber to an area beneath the surface of a liquid, such as water, contained in a mixing tank.

The low velocity turbulent jets of polymer powder and air serve to disburse the polymer as well as enhance the amount of low shear mixing present at the moment of polymer introduction into the water. A prop-mixer is used to maintain gentle agitation of the liquid beyond the powder and air mixture injection points, to uniformly disperse the powder throughout the solution, thereby avoiding a high local concentration of the powder.

This technique allows for 700 grams per hour of Polyox ® polymer to be dissolved into a liquid solution without generating large "fish eggs" or un-hydrated patches or clumps of powder. The present method also avoids high shear stresses that were previously created in the prior art systems. These high shear stresses are responsible for the breakdown the long molecular chains of polymers. The present invention mixes the resin with low shear stresses, thereby avoiding the breakdown of the polymer molecular chains. Due to the highly uniform mixing in the present invention, locally high molecular concentrations are avoided and a higher concentration of dissolved powder in the water is achieved than in the prior art.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein.

DESCRIPTION OF THE PREFERRED EMBODIMENT

Figure 1:
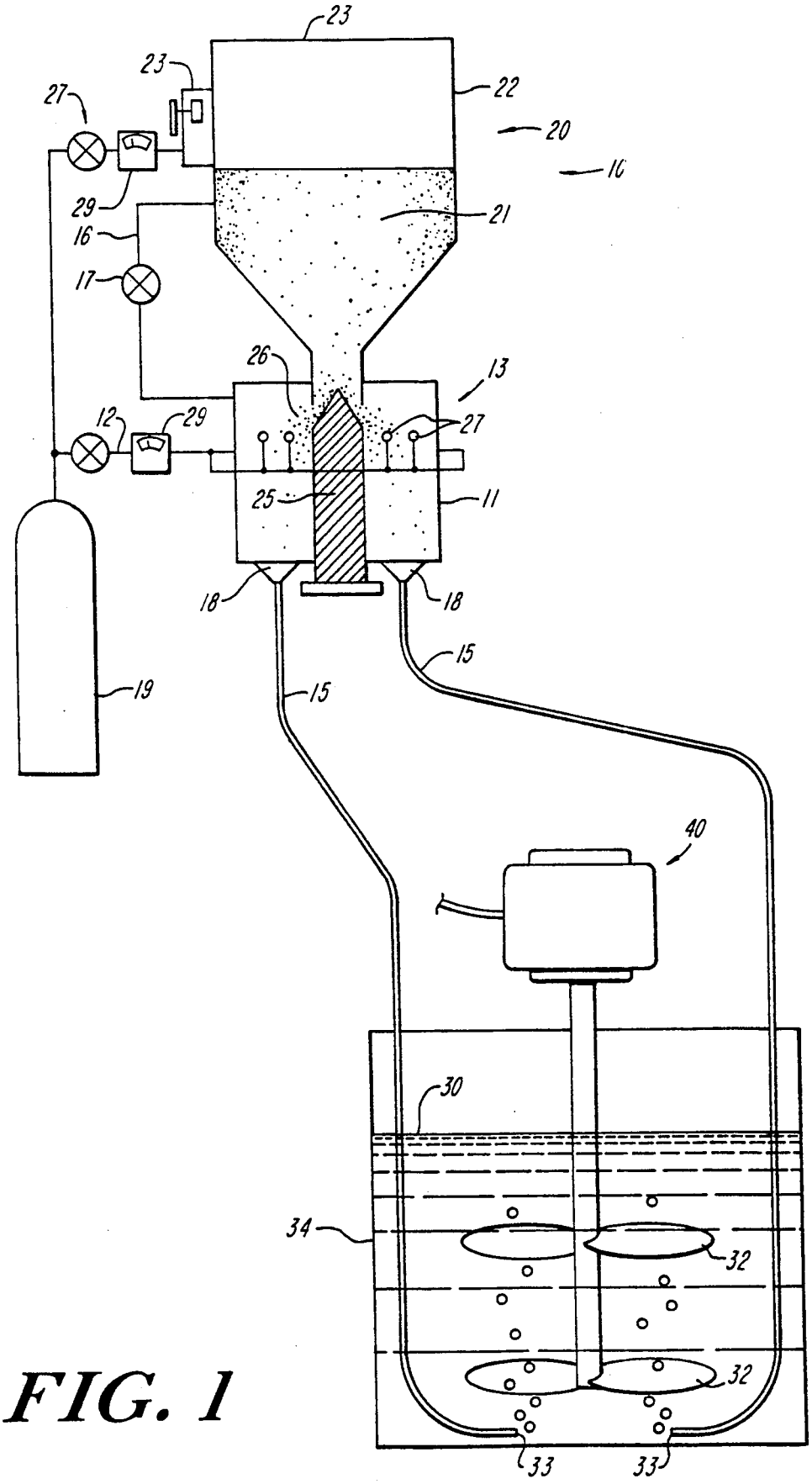
FIG. 1 is a schematic representation of the mixing apparatus of the present invention.

The system 10, according to the present invention includes a powder aerator system 13 including a vibrating hopper 20 and a powder and air mixing chamber 11. The hopper 20 holds the powder to be dissolved 21 and includes a cylindrically shaped hopper portion 22 having a removable plexiglass top 23, and a funnel shaped bottom portion 24.

The opening 26 in the funnel shaped bottom portion 24 of hopper 20 can be opened and closed by means such as a large set screw 25. Adjustment of the set screw and of the vibration rate of the hopper allows for the powder feed rate to be controlled.

The vibrating mechanism may include an air powered, nonconcentric spinning wheel 23 whose speed can be controlled through means such as air pressure regulator 27 which controls the air pressure from pressurized air supply 19. It is understood, however, that any vibration mechanism which can be controlled may be utilized. SCFH (standard cubic feet per hour) air flow meters 29 can be used to monitor the volumetric flow of both the air driving the vibration of hopper 20, as well as the polymer and air mixing chamber air flows.

The powder 21 to be dissolved in a liquid and contained in the hopper 20 flows into the powder and air mixing chamber 11 and is mixed with pressurized air from pressurized air source 19. The pressurized air is fed into the powder and air mixing chamber by one or more pressurized air inlets or jets 27 which are supplied pressurized air by means of air supply line 12. Pressurized air is supplied at low pressure (approximately 20 PSIG) with a volume flow rate of 12 CFM.

The air pressure in the hopper 20 and the air pressure in the mixing chamber 11 is balanced by means of an air line 16 between the two which can be closed by an in-line valve 17. The mixing chamber is preferably made of plexiglass so that the flow rate of the powder being discharged into the mixing chamber can be visually monitored.

The powder and air mixing chamber also include exit ports 18 coupled to supply lines 15, which serve to carry the pressurized powder and air mixture to the liquid filled mixing tank 34.

The complete system is held in the place above a deep cylindrical tank 34 by placement upon a metal or wooden structure. In the exemplary system, a cylindrical stainless steel tank, 3 feet in diameter and 3 feet deep was utilized.

The present system also includes a variable speed mixer, generally indicated at 40, having one or more blades or paddles 32, which is mounted in the tank. An electric power supply source (not shown) supplying 110 volts/60 amps and an air supply of typically at least 15 SCFH are required for the mixing process. The mixer 40 is used for gentle agitation of the polymer solution as the powder is injected into the tank.

Initially, the mixer can be set to a higher mixing speed, such as 100 rpm, to get the water rotating about its axis. Once the powder and air mixture begins flowing into the liquid, a slower mixing speed, such as 50 rpm, will suffice to encourage mixing and dissolving of the powder while still reducing the molecular shearing of the polymer which avoids breaking the long polymer molecules. The desired rpm level depends on the polymer type to be dissolved.

To begin the mixing process, the tank 34 is filled to the desired height with water or other liquid. The inside of the tank 34 may be marked with calibrating marks, such as a yard stick, for indicating how many gallons of water are held in the tank (i.e. 38 and ⅝ inches in a 3 foot diameter tank is equal approximated to 120 gallons). One gallon of water equals 3,785 cc's which equals 3785 grams. In order to form a solution of 0.8 percent polymer dissolved in the water, for example: 120 gallons of water equals 454,200 grams of water; and 0.8 percent of 454,200 grams is approximately 3,633.6 grams ($450{,}200 \times 0.008 = 3{,}633.6$). Therefore, by adding 3,633.6 grams of the polymer to the 120 gallons of water results in approximately a 0.8 percent polymer solution.

Once the total amount of polymer to be dissolved has been computed as shown above, the plexiglass cover 23 of the hopper 20 can be removed for the addition of the requisite amount of powder to the hopper. It is important not to overload the hopper, and to make sure that the plexiglass cover plate is securely and tightly back in place. Screws or some sort of a latch are preferably used to tightly secure the cover on top of the hopper.

With the funnel and bypass valves closed, the air pressure regulator to the vibrator can be opened so that the corresponding air flow meter preferably reads 70 to 80 SCFH to begin vibrating the hopper. Exit ports 18 and supply lines 15 are preferably attached to the bottom of the mixing chamber 11 such that they point safely downwards or away from the operator. The mixing chamber 11 can now be pressurized to 5 PSIG and the air lines can be checked for leaks or blockage. With all the air lines secured, the pressurized powder and air mixture supply lines 15 can be inserted into the liquid mixing tank 34 so that they discharge the pressurized powder and air mixture into the center of the tank 34 and below the surface 30 of the liquid.

The supply lines 15 should never be submerged without air flowing through them else polymer dust on the interior walls of the lines will cake and block the tubes if water is present in the tank. The supply lines 15 are all of equal length, so minimal maneuvering is necessary to get a symmetric blowing pattern in the tank. The position of the supply line exits 33 is critical to the mixing process. The line exit positions 33 must be placed away from the tank walls and as close as possible to the mixer blades 32 to encourage agitation and dispersion of the powder and air mixture as it comes in contact with the water.

The water agitating tank 34 is preferably supplied with ducts extending down along the inside of the tank wall to the bottom of the tank (not shown) for insertion of the supply lines 15 to keep the lines free of the blades of the mixer.

To begin mixing, a bypass valve 17 is opened to equalize the pressure between the hopper 20 and mixing chamber 11. After increasing the air flow rate to about 200 SCFH at a relatively low pressure of about 20 PSIG, the set screw 25 is turned to open the funnel gap or opening 26 to allow discharge of powder from the hopper 20 to the mixing chamber 11.

The vibration of the hopper 20 can be adjusted along with the gap opening 26 of the hopper funnel, to achieve the desired powder flow rate into the mixing chamber 11. Selecting the powder flow rate is dependent on many variables, for example: humidity, barometric pressure, the size of the powder particles, and the hardness and temperature of the water. Therefore, this parameter is by no means easy and clearly defined.

The hopper must maintain an adequate supply or flow of powder to the mixing chamber without allowing the powder to collect inside the chamber, thus blocking the exit ports 18.

Recognizing just how much powder to release into the powder and air mixing chamber 11 requires some experimentation. Too much air in the mixture will increase the total mixing time, exhaust the air supply, and increase the air content of the final solution. Not enough air will increase the likelihood of "fish eggs" or unhydrated polymer patches or clumps in the solution.

A good balance has been achieved with Polyox® by dispatching 700 grams of polymer per hour at 200 SCFH. The level of the powder in the hopper should be checked every 15 minutes or so through the top plate of the hopper so that more powder can be added as needed.

As soon as the powder in the hopper has been exhausted, the vibrator may be stopped, and the air flow pressure may be lowered to 5 PSIG to make sure that air is still flowing to the tank through air lines 15, to keep the air lines dry, while the bypass valve 17 and the funnel gap 26 are closed.

Though the funnel gap cannot be closed air tight, pressure within the mixing chamber can be substantially maintained by tightly closing the set screw 25 by hand. This will allow the top plate of the hopper to be opened, more polymer powder added to the hopper, and the top plate replaced without de-pressurizing the mixing chamber or air lines, thereby saving time and conserving pressurized air.

Once the hopper is re-filled with powder and the top closed, the vibrator can be started and the bypass valve opened to pressurize the hopper. Air mixing pressure may be increased to 20 PSIG, at which time the operator may slowly open the funnel opening 26 to begin mixing powder again.

Once the total amount of polymer powder to be added to the water has been mixed, the mixer is shut down by stopping the vibrator, closing the funnel gap, removing the air lines from the tank and shutting off the air supply to the mixing tank the mixing chamber.

The present invention avoids the need to suspend the polymer powder in the carrier fluid as an emulsion or slurry (such as glycerol) prior to dissolving in water. Further, the present invention avoids the labor intensive practice of hand mixing the polymer powder directly into water. By using a low air pressure to mix the powder with the air and to supply and inject the air powder mixture into the water tank, and by the additional use of a gentle, slow mechanical mixing apparatus, the powder is mixed into the water with low shear stresses so as to not degrade or shear the polymers.

Obviously, many modifications and variations of the present invention may become apparent in light of the above teachings. For example: an electric vibrator may be used in place of the pneumatic vibrator as disclosed, and a metering valve or similar control device may be used in place of the adjustable set screw to control the rate of flow of the powder from the hopper to the mixing chamber.

In light of the above, it is therefore understood that within the scope of the appended claims, the invention may be practiced otherwise than as specifically described.

What is claimed is:

1. An apparatus for dissolving powder into a liquid, comprising:

a powder supply device, coupled to a powder and air mixing chamber, for providing a flow of said powder to be dissolved into a liquid, to said powder and air mixing chamber;

a pressurized air source, coupled to at least one pressurized air inlet of said powder and air mixing chamber, for supplying pressurized air to said powder and air mixing chamber through said at least one pressurized air inlet, for mixing said powder with said pressurized air for providing a powder and air mixture, and for pressurizing said powder and air mixing chamber;

a powder and liquid mixing tank including a quantity of said liquid into which said powder is to be dissolved, said quantity of said liquid in said mixing tank defining a liquid surface region;

at least one powder and air mixture supply line, coupled between said pressurized powder and air mixing chamber and a bottom region of said powder and liquid mixing tank, for supplying, under pressure, said powder and air mixture to said bottom region of said powder and liquid mixing tank, below said surface region of said liquid; and a variable speed mechanical agitator, disposed in said liquid in said powder and liquid mixing tank, for agitating said liquid in said mixing tank while said powder and air mixture is supplied to said bottom region of said powder and liquid mixing tank, to provide generally uniform distribution and dissolution of said powder in said liquid.

2. An apparatus according to claim 1 wherein said pressurized air source supplies air to said air mixing chamber at a low pressure.

3. An apparatus according to claim 2 wherein said pressurized air is supplied at 20 PSIG.

4. An apparatus according to claim 1 wherein said powder supply device includes a vibrating hopper.

5. An apparatus according to claim 4 wherein said hopper is vibrated by a non-concentric spinning wheel.

6. An apparatus according to claim 4 wherein said hopper is vibrated by an air powered vibrator.

7. An apparatus according to claim 1 wherein said powder supply device further comprises means for adjusting the flow of said powder from said powder supply device to said powder and air mixing chamber.

8. An apparatus according to claim 1 further comprising:

an air pressure regulator and an air flow meter, coupled between said pressurized air source and said powder and air mixing chamber, for providing monitoring and adjusting of said pressurized air flowing from said pressurized air source to said powder and air mixing chamber.

9. An apparatus according to claim 1 further comprising:

an air line coupled between said air powder and air mixing chamber and said powder supply device, for equalizing the air pressure in said powder supply device with the air pressure in said powder and air mixing chamber; and a valve, disposed in said air line, for closing and opening said air line.

10. An apparatus according to claim 1 wherein said powder includes a polymer.

11. An apparatus according to claim 10 wherein said polymer includes a water soluble resin polymer.

12. An apparatus according to claim 11 wherein said liquid includes water.

13. An apparatus for dissolving a water soluble resin polymer into a liquid, comprising:

a water soluble resin polymer supply device, coupled to a water soluble resin polymer and air mixing chamber, for providing a flow of said water soluble resin polymer to be dissolved into a liquid, to said water soluble resin polymer and air mixing chamber;

a pressurized air source, coupled to at least one pressurized air inlet of said water soluble resin polymer and air mixing chamber, for supplying pressurized air to said water soluble resin polymer and air mixing chamber through said at least one pressurized air inlet, for mixing said water soluble resin polymer with said pressurized air for providing a water soluble resin polymer and air mixture, and for pressurizing said water soluble resin polymer and air mixing chamber;

a water soluble resin polymer and liquid mixing tank including a quantity of said liquid into which said water soluble resin polymer is to be dissolved, said quantity of said liquid in said mixing tank defining a liquid surface region;

at least one water soluble resin polymer and air mixture supply line, coupled between said pressurized water soluble resin polymer and air mixing chamber and a bottom region of said water soluble resin polymer and liquid mixing tank, for supplying, under pressure, said water soluble resin polymer and air mixture to said bottom region of said water soluble resin polymer and liquid mixing tank, below said surface region of said liquid; and a mechanical agitator, disposed in said liquid in said water soluble resin polymer and liquid mixing tank, for agitating said liquid in said mixing tank while said water soluble resin polymer and air mixture is supplied to said bottom region of said water soluble resin polymer and liquid mixing tank, to provide generally uniform distribution and dissolution of said water soluble resin polymer in said liquid.

14. A method for dissolving powdered water soluble resin polymers in water, comprising the steps of:

mixing said powdered water soluble resin polymer with low pressure air;

supplying said powdered water soluble resin polymer air mixture under low pressure to the bottom of a water mixing tank, having water therein; and gently agitating said water to more uniformly distribute and dissolve said powder into said water.

15. The method of claim 14 further comprising the steps of:

mixing said powdered water soluble resin polymer with said low pressure air in a polymer and air mixing chamber; and injecting said low pressure air into said polymer and air mixing chamber through at least one mixing chamber air jet, for mixing said polymer with said air, and for pressurizing said mixing chamber to said low pressure.

16. The method of claim 15 further comprising the steps of:

supplying said powdered water soluble resin polymer to said polymer and air mixing chamber by means of a vibrating hopper.

* * * * *